US006796389B2

(12) United States Patent
Pusateri et al.

(10) Patent No.: US 6,796,389 B2
(45) Date of Patent: Sep. 28, 2004

(54) POWER HAND TOOL AND REMOVABLE GRIP THEREFOR

(75) Inventors: Daniel S. Pusateri, Grayslake, IL (US); John A. Pierman, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/176,777

(22) Filed: Jun. 24, 2002

(65) Prior Publication Data

US 2003/0183401 A1 Oct. 2, 2003

Related U.S. Application Data

(60) Provisional application No. 60/368,274, filed on Mar. 28, 2002.

(51) Int. Cl.[7] ..... B25B 13/00

(52) U.S. Cl. ..... 173/170; 173/171; 173/162.2

(58) Field of Search ..... 173/170, 171, 173/162.2, 162.1; 16/422, 114 R; 81/177.1; 74/551.8, 543, 544, 523, 557

(56) References Cited

U.S. PATENT DOCUMENTS

| | | | | |
|---|---|---|---|---|
| 2,222,336 A | * | 11/1940 | Domellof | 16/426 |
| 2,334,172 A | | 11/1943 | Champayne | |
| 3,309,096 A | | 3/1967 | Inka | |
| 3,414,910 A | * | 12/1968 | Provi et al. | 4/577.1 |
| 3,799,447 A | * | 3/1974 | Beal | 239/288.5 |
| 3,826,271 A | | 7/1974 | Sattler et al. | |
| 3,923,191 A | * | 12/1975 | Johnson | 220/760 |
| 4,050,003 A | * | 9/1977 | Owings et al. | 320/113 |
| 4,189,248 A | * | 2/1980 | Sully | 403/11 |
| 4,204,539 A | | 5/1980 | Van Brugge | |
| 4,218,047 A | | 8/1980 | Douglas | |
| 4,308,770 A | | 1/1982 | MacDonald | |
| 4,445,710 A | | 5/1984 | Borel | |

(List continued on next page.)

FOREIGN PATENT DOCUMENTS

DE 297 11 172 U 1 6/1997

*Primary Examiner*—Scott A. Smith
*Assistant Examiner*—Paul Durand
(74) *Attorney, Agent, or Firm*—Seyfarth Shaw LLP

(57) ABSTRACT

A power hand tool body has a barrel with a depending skirt portion from which depends an elongated handle. Elongated grooves are formed in opposite sides of the skirt portion and extend between forward and rearward ends thereof, the grooves being part-cylindrical in transverse cross-section and having rectangular cross-section neck portions opening at the sides of the skirt. A hollow tubular grip formed of flexible and resiliently stretchable material has an end portion with part-cylindrical attachment members extending laterally and inwardly from opposite sides thereof so that, when the grip is slipped over the handle, the end portion may be stretched to insert the attachment members respectively into ends of the grooves for retaining the grip in place.

18 Claims, 4 Drawing Sheets

U.S. PATENT DOCUMENTS 4,473,024 A 9/1984 Armstrong
4,651,929 A * 3/1987 Kranzle ..... 239/288
4,754,516 A * 7/1988 Tremblay ..... 15/176.6
4,936,394 A * 6/1990 Ohtsu ..... 173/162.2
5,074,081 A * 12/1991 Beth et al. ..... 451/344
5,267,487 A 12/1993 Falco et al.
5,332,156 A * 7/1994 Wheeler ..... 239/288
D354,110 S 1/1995 Scott et al.
5,390,972 A * 2/1995 Galloway ..... 294/27.1
5,558,570 A * 9/1996 Nakamura et al. ..... 451/357
5,638,577 A * 6/1997 Gooding et al. ..... 16/422
5,640,741 A 6/1997 Yano
5,718,253 A 2/1998 McNamee
5,868,181 A 2/1999 Alvern et al.
5,911,497 A * 6/1999 Mele ..... 362/202
5,911,798 A * 6/1999 Arnold ..... 81/177.2
5,967,692 A 10/1999 Tabellini
6,006,403 A 12/1999 Battiato
6,014,785 A * 1/2000 Punch et al. ..... 7/105
D420,879 S 2/2000 Watson et al.
6,024,903 A 2/2000 Naft et al.
6,082,468 A 7/2000 Pusateri et al.
6,155,354 A * 12/2000 Pusateri et al. ..... 173/170
6,161,256 A 12/2000 Quiring et al.
6,220,969 B1 4/2001 Lilley
6,237,192 B1 5/2001 Garrison et al.
6,260,733 B1 * 7/2001 Eimerman ..... 220/759
6,286,610 B1 9/2001 Berger et al.
6,308,378 B1 10/2001 Mooty et al.

* cited by examiner

POWER HAND TOOL AND REMOVABLE GRIP THEREFOR

RELATED APPLICATION

This application claims the benefit of the filing date of U.S. Provisional Application No. 60/368,274, filed Mar. 28, 2002.

BACKGROUND

This application relates to ergonomic tool grips and, in particular, to grips for power hand tools. The application relates specifically to a removable hand grip and means for retention of same on the associated power hand tool.

The removable grip disclosed herein is an improvement of grips disclosed in U.S. Pat. No. 6,082,468. That patent discloses two versions of removable grips for power tool handles, but both require the use of tools to mount the grip in place. In one version, the grip has a peripheral rib which seats in a shallow groove on the tool body for positional purposes, and a flange which is clamped between a rear end cap and the rear face of the tool housing. The flange has dowel-like members, the forward ends of which fit into complementary holes in the rear end face of the tool housing, and the rearward ends of which fit into complementary holes in a rear end cap, which is secured in place on the tool housing by associated fasteners. Accordingly, the grip is not secured in place until the end cap is mounted, clamping the grip flange.

In another version of removable grip disclosed in that patent, the grip is retained in place by an attachment plate and associated fitting which are secured to the distal end of the handle and retained in place by suitable fasteners.

SUMMARY

There is described in this application an improved removable hand grip for a power hand tool, which avoids the disadvantages of prior hand grips while affording additional structural and operating advantages.

An important aspect is the provision of a removable hand grip which is of simple and economical construction and can be easily mounted and demounted on a power tool handle without clamping between parts of the power tool.

In connection with the foregoing aspect, a further aspect is the provision of a removable grip of the type set forth, which affords good ergonomic design and comfort in use, while also affording a secure mounting on the associated power tool.

Yet another aspect is the provision of the combination of a power hand tool and a removal hand grip therefor, of the type set forth.

A still further aspect is the provision of a method for mounting a removable hand grip on the handle of a power hand tool, without the use of tools and without clamping between parts of the power tool.

Certain ones of these and other aspects may be obtained by providing a hand grip for a hand tool comprising: a hollow generally tubular body having a flexible and resiliently stretchable end portion, and spaced-apart elongated attachment members carried by the end portion and extending therefrom, the members respectively having longitudinal axes disposed substantially parallel to one another in an at-rest condition of the end portion.

BRIEF DESCRIPTION OF THE DRAWINGS

For the purpose of facilitating an understanding of the subject matter sought to be protected, there are illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figures 1, 2:
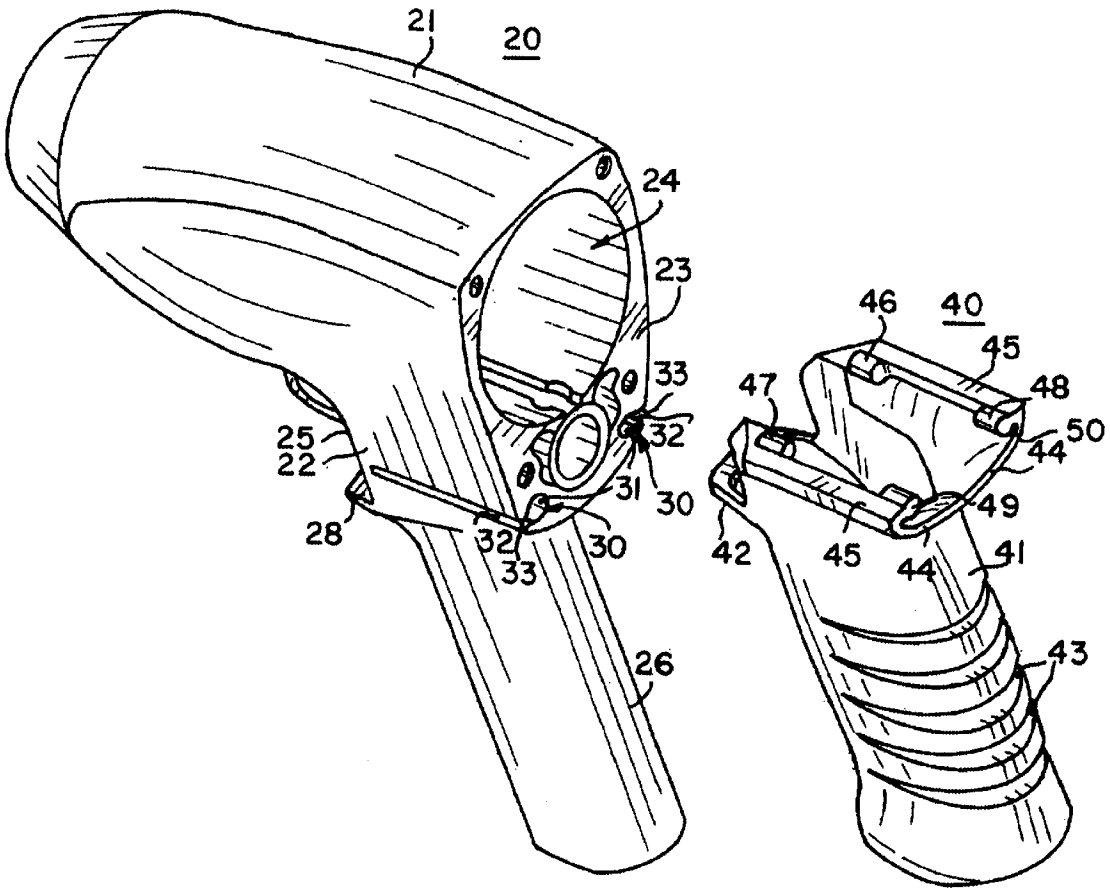
FIG. 1 is a rear perspective view of the tool body of a power hand tool.
FIG. 2 is a rear perspective view of a removable hand grip for covering the handle portion of the tool body of FIG. 1.
Figure 3:
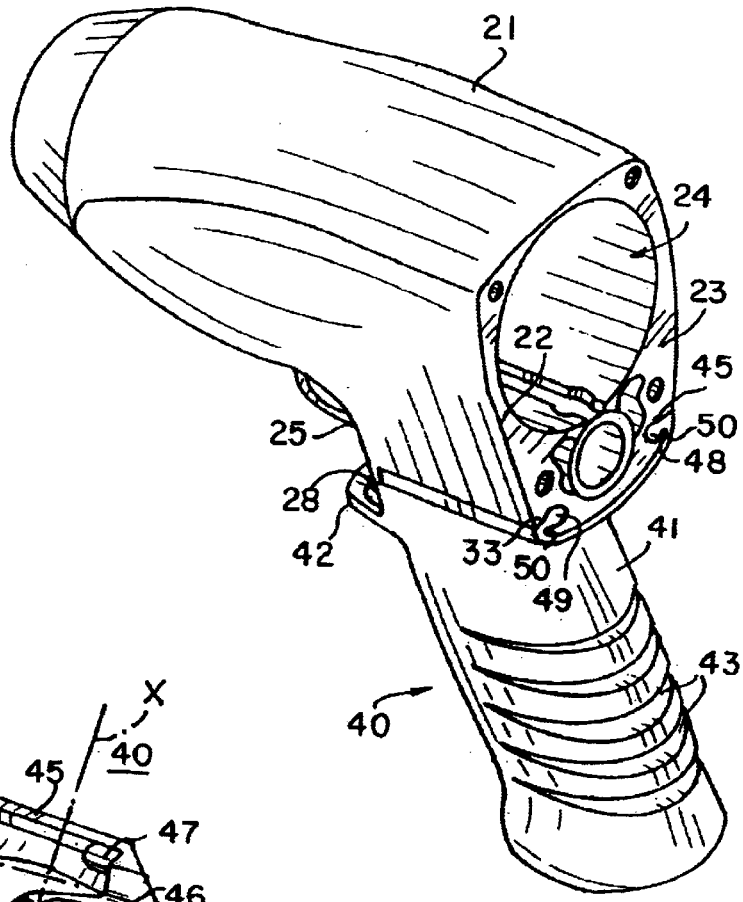
FIG. 3 is an enlarged view similar to FIG. 1, with the grip of FIG. 2 mounted in place on the tool handle.
Figure 7:
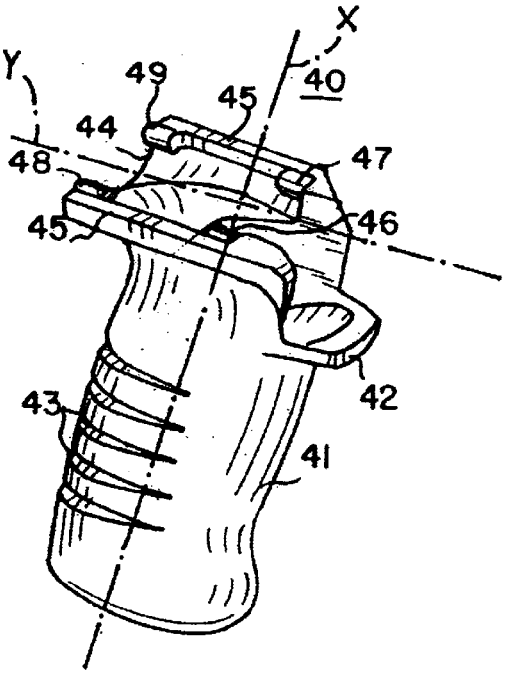
FIG. 7 is a reduced front perspective view of the hand grip shown in FIG. 2.
Figure 4:
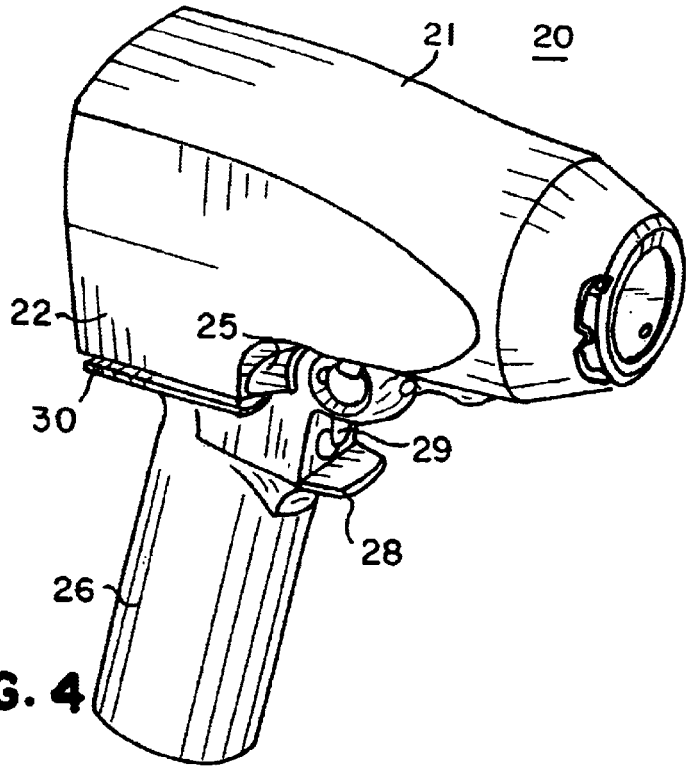
FIG. 4 is a reduced front perspective view of the tool housing of FIG. 1.
Figure 5:
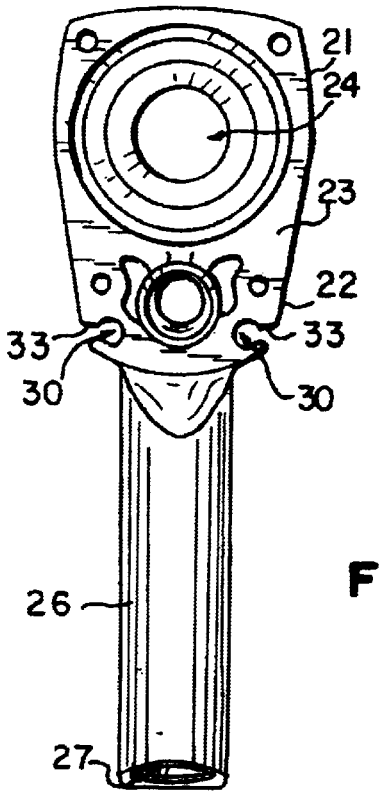
FIG. 5 is a rear elevational view of the tool housing of FIG. 4.
Figure 6:
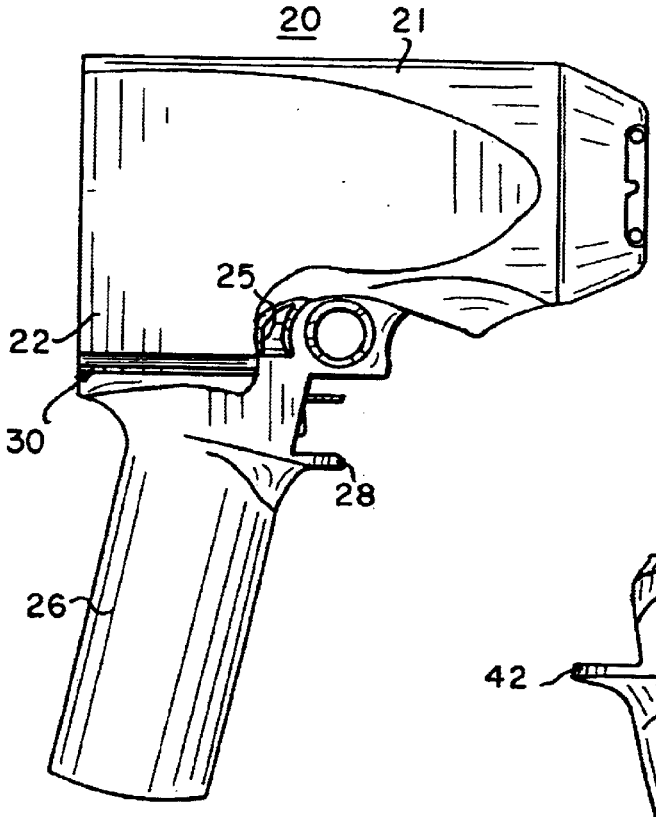
FIG. 6 is a side elevational view of the tool housing of FIG. 4.
Figure 8:
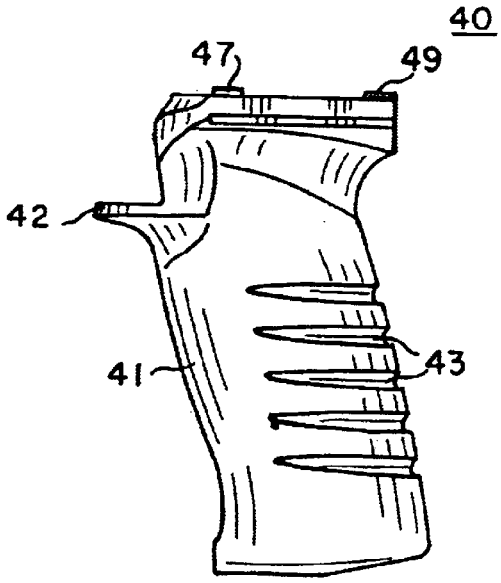
FIG. 8 is a side elevational view of the grip of FIG. 7.
Figure 9:
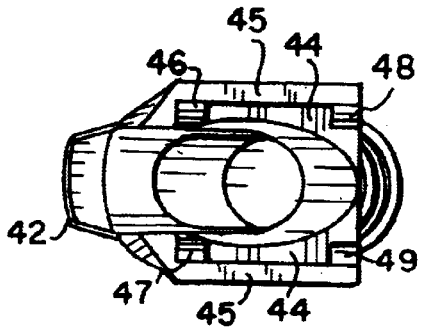
FIG. 9 is a top plan view of the grip of FIG. 8.

Referring now to FIGS. 1 and 3–6, there is illustrated a tool housing or body, generally designated by the numeral 20, for a pneumatic power tool, such as an impact wrench. The tool housing 20 has a main barrel portion 21 which is provided adjacent to the rear end thereof with a depending skirt portion 22. The main barrel portion 21 and associated skirt portion 22 have a common rear end face 23, in which is formed a motor cavity 24 which extends forwardly through the main barrel 21 portion. The rear end of the motor cavity 24 is adapted to be closed by an associated end cap or plate (not shown), which may be secured in place by associated fasteners, all in a known manner. The skirt portion 22 extends forwardly less than half the length of the main barrel portion 21 and terminates at a sloping front face 25. Depending from the skirt portion 22 is an elongated handle portion 26 having an axial bore 27 therein (see FIG. 5). Projecting forwardly from the handle portion 26 adjacent to the upper end thereof is a trigger guard 28, above which is formed a trigger cavity 29 (FIG. 4)

Formed in the lower end of the skirt portion 22, respectively on opposite sides thereof, are two elongated retention grooves 30, each extending from the rear end face 23 to the front face 25. Each of the retention grooves 30 has a part-cylindrical main portion 31 and an inlet channel 32 which is generally rectangular in transverse cross section and communicates with the main portion 31 along an outer chord thereof, which subtends substantially less than 180° of the main portion 31. Each of the inlet channels 32 defines along its upper edge a rectangular seat surface 33, which extends the length of the associated retention groove 30.

Referring also to FIGS. 2 and 7–9, there is illustrated a removable hand grip 40, which is formed of a flexible and resiliently stretchable cushioning material, such as a suitable rubber, and has an elongated, hollow main body 41 having a longitudinal first axis "X", generally oval in transverse cross section, and is provided adjacent to the upper end thereof with a forwardly projecting trigger guard cover 42. Formed in the rear portion of the outer surface of the main body 41 are longitudinally spaced-apart grip grooves 43 which extend circumferentially part way around the main body 41. The upper end of the main body 41 terminates in a pair of laterally-outwardly extending flanges 44, respectively having upper seat surfaces 45. Respectively integral with the flanges 44 and projecting laterally inwardly therefrom are two front dowel-like attachment members 46 and 47 and two rear dowel-like attachment members 48 and 49, each of the members 46–49 being joined to the associated flange 44 by a short rectangular neck 50, so that each attachment member projects from the flange 44 in a direction generally perpendicular to the longitudinal axis of the attachment member. The attachment numbers 46–49 are part-cylindrical in shape, with the attachment members 46 and 48 being substantially coaxial parallel to a second axis "Y" and the attachment members 47 and 49 being substantially coaxial parallel to the second axis "Y" in the at-rest condition of the grip 40.

Referring in particular to FIG. 3, the installation of the grip 40 on the handle portion 26 will be described. While this description is in the context of the empty tool housing 20, it will be appreciated that typically, the grip 40 would be installed after the internal components of the power tool had been mounted in place in the tool housing 20. In installation of the grip 40, the lower end of the tool housing handle portion 26 is fitted into the upper end of the hollow main body 41 of the grip 40, and the trigger guard cover 42 is fitted over the forward end of the trigger guard 28. After the grip 40 has been pushed up until it bears against the underside of the skirt portion 22, the forward ends of the flanges 44 are stretched to pull the front attachment members 46 and 47 forwardly of the front ends of the retention grooves 30, and then released to allow the rear ends of the attachment members 46 and 47 to be inserted into the forward ends of the retention grooves 30. Then, similarly, the rear ends of the flanges 44 are stretched to position the rear attachment members 48 and 49, respectively in the rear ends of the retention grooves 30. When thus installed in place, the necks 50 will be disposed in the inlet channels 32 of the retention grooves 30 and the seat surfaces 45 of the grip 40 will be disposed against the seat surfaces 33 on the tool skirt portion 22. Each of the attachment members 46–49 has a diameter substantially greater than the height of the inlet channels 32, so that they cannot be pulled laterally out of the retention grooves 30. The end cap of the tool housing 20 may then be mounted in place.

The grip 40 will thus be firmly and securely mounted in place and cannot be accidentally removed or pulled free in use. It can be seen that this simple and easy mounting or installation procedure requires no clamping action and results in a very secure and firm mounting. In order to remove the grip 40, the flanges 44 are again stretched to disengage the dowel-like members 46–49 from the retention grooves 30, one end at a time, again without any unclamping.

While, in the illustrated embodiment, the attachment members 46–49 are relatively short, it will be appreciated that they could be provided in any desired length. It will also be understood that, because of the undercut shape of the retention grooves 30, once the attachment members 46–49 have been installed in place in the retention grooves 30, the narrow inlet channels 32 will prevent the attachment members 46–49 from being pulled laterally out of the retention grooves 30. While a single groove 30 has been provided on each side of the skirt portion 22, separate grooves for each attachment member could be provided.

From the foregoing, it can be seen that there has been provided an improved removable ergonomic grip for a power hand tool, and a combination of power hand tool and grip, which affords a cushioned, comfortable grip and is of simple and economical construction. There has been provided a method whereby such a grip may be readily mounted to a secure mounting position on a power tool and demounted therefrom, without any clamping action.

While a particular embodiment of the removable grip and associated power hand tool has been shown and described, it will be apparent to those skilled in the art that changes and modifications may be made without departing from the principles of the removable grip and hand tool in its broader aspects. The matter set forth in the foregoing description and accompanying drawings is offered by way of illustration only and not as a limitation.

What is claimed is:

1. A hand grip for a hand tool comprising:

a hollow generally tubular body extending along a first axis and having a pair of spaced-apart flanges at an end portion thereof respectively extending laterally toward each other, each flange being elongated in a direction substantially parallel to a second axis inclined with respect to the first axis and having a first thickness along its entire length, each flange including at least one attachment member extending laterally therefrom toward the other flange only adjacent to an end thereof, each attachment member being elongated in a direction substantially parallel to the second axis and having a second thickness along its entire length substantially greater than the first thickness, the attachment members and adjacent portions of the flanges being flexibly and resiliently stretchable relative to the body in directions generally parallel to the second axis.

2. The grip of claim 1, wherein attachment members are disposed on opposite sides of the end portion.

3. The grip of claim 1, wherein the attachment members are four in number.

4. The grip of claim 3, wherein two attachment members are disposed on each of opposite sides of the end portion.

5. The grip of claim 1, wherein each of the attachment members is part-cylindrical in shape.

6. The grip of claim 5, wherein each flange is substantially rectangular in transverse cross section.

7. The grip of claim 1, wherein the entire tubular body is formed of a flexible and resiliently stretchable material.

8. In combination:

a hand tool having a body including a handle extending along a first axis and a barrel extending from the handle along a second axis inclined with respect to the first axis, the body having elongated recesses formed therein adjacent to a junction between the barrel and the handle, each recess opening at an end of the body and at a side of the body and having a longitudinal axis extending substantially parallel to the second axis;

each recess having a cross-sectional share alone its entire length which includes an outer portion of a first thickness opening at a side of the body and an inner portion of a second thickness greater than the first thickness, and a grip including a hollow generally tubular body extending substantially parallel to the first axis and having a pair of spaced-apart flanges at an end portion thereof each extending longitudinally substantially parallel to the second axis and sized and shaped to be received in an outer portion of an adjacent recess, each flange including at least one attachment member extending laterally therefrom and elongated in a direction substantially parallel to the second axis and sized and shaped to be received only in an inner portion of an adjacent recess, the attachment members and adjacent portions of the flanges being flexibly and resiliently stretchable relative to the tubular body in directions generally parallel to the second axis the grip being disposable in a mounted condition wherein the attachment members are respectively receivable in the recesses only from the ends of the hand tool body when the handle is received in the tubular body of the grip.

9. The combination of claim 8, wherein the recesses include two continuous grooves respectively formed in opposite sides of the hand tool body and each extending between front and rear end surfaces on the hand tool body.

10. The combination of claim 9, wherein each of the grooves includes a portion part-cylindrical in transverse cross sectional shape.

11. The combination of claim 8, wherein the tubular body of the grip is formed of a flexible and resilient cushioning material.

12. The combination of claim 11, wherein the attachment members include members respectively disposed on opposite sides of the end portion.

13. The combination of claim 12, in the attachment members include two members on each of opposed sides of the end portion.

14. A method of mounting a grip on a handle of a hand tool having a barrel portion from which the handle extends and recesses opening at ends and sides of the barrel portion, the method comprising:

providing a hollow generally tubular grip extending along a first axis and having a flexible resiliently stretchable end portion with a pair of spaced-apart flanges thereon each extending longitudinally substantially parallel to a second axis inclined with respect to the first axis wherein each flange includes at least one attachment member extending laterally therefrom and elongated in a direction substantially parallel to the second axis and receivable in one of the recesses only from an end thereof, slipping the grip over the handle, end portion first, until the attachment members are disposed adjacent to the barrel portion, and stretching the end portion of the grip to bring the attachment members respectively into longitudinal alignment with the ends of adjacent recesses, and inserting the attachment members respectively into the recesses from the ends thereof.

15. The method of claim 14, wherein the recesses includes recesses respectively disposed on opposite sides of the barrel portion.

16. The method of claim 15, wherein the providing step includes providing a grip with attachment members respectfully disposed on opposite sides of the end portion of the grip.

17. The method of claim 16, wherein the providing step includes providing a grip with four attachment members including two attachment members on each of the opposite sides of the end portion.

18. The method of claim 14, wherein the stretching step includes stretching the end portion adjacent to one attachment member at a time.

* * * * *